US005291756A

United States Patent [19]

Venturini

[11] Patent Number: 5,291,756

[45] Date of Patent: Mar. 8, 1994

[54] KNITTING MACHINE WITH NEEDLE SELECTING DEVICE

[75] Inventor: Marco Venturini, Genova, Italy

[73] Assignee: S.F.I.M. S.r.l., Brescia, Italy

[21] Appl. No.: 922,406

[22] Filed: Jul. 31, 1992

[30] Foreign Application Priority Data

Aug. 23, 1991 [IT] Italy ..... MI91A002283

[51] Int. Cl.[5] ..... D04B 9/46

[52] U.S. Cl. ..... 66/219; 66/116

[58] Field of Search ..... 66/219, 220, 221, 116, 66/121, 122, 123, 119, 120

[56] References Cited

U.S. PATENT DOCUMENTS

| | | | |
|---|---|---|---|
| 3,709,033 | 1/1973 | Widdowson et al. | 66/221 X |
| 3,972,206 | 8/1976 | Mureso | 66/219 |
| 4,197,722 | 4/1980 | Cote-Petit et al. . | |
| 4,282,724 | 8/1981 | Elsässer | 66/219 X |
| 4,688,404 | 8/1987 | Elsässer et al. | 66/219 |
| 4,884,417 | 12/1989 | Tenconi | 66/220 |
| 4,989,424 | 2/1991 | Furia | 66/219 |

FOREIGN PATENT DOCUMENTS

| | | | |
|---|---|---|---|
| 0189790 | 8/1986 | European Pat. Off. . | |
| 1966773 | 4/1974 | Fed. Rep. of Germany . | |
| 2453275 | 5/1975 | Fed. Rep. of Germany | 66/220 |
| 1354980 | 5/1974 | United Kingdom | 66/219 |
| 2043120 | 10/1980 | United Kingdom . | |

*Primary Examiner*—Andrew M. Falik
*Assistant Examiner*—John J. Calvert
*Attorney, Agent, or Firm*—Guido Modiano; Albert Josif; Daniel O'Byrne

[57] ABSTRACT

The knitting machine with needle selection device has a plurality of needles or sub-needles each having a body with at least one magnetized portion. A selection element faces the magnetized portion and is constituted by a plate which is physically separate from the body of the needle or sub-needle and is made of a material which can be magnetized. The selection device has a magnetizing device which acts controllably upon the selection element of the various needles or sub-needles in order to induce a magnetic interaction between the magnetized portion of the body of the needle or sub-needle and the selection element itself. Actuation cams act on the body of the needle or sub-needle, after the action of the magnetizing device, and cause a diversified actuation of the needle or sub-needle depending on the magnetic interaction induced between the portion of the body of the needle or sub-needle and the selection element.

15 Claims, 3 Drawing Sheets

KNITTING MACHINE WITH NEEDLE SELECTING DEVICE

BACKGROUND OF THE INVENTION

The present invention relates to a knitting machine with needle selection device, for manufacturing socks or stockings.

As is known, knitting machines generally comprise a planar or cylindrical needle supporting element in which a plurality of mutually adjacent grooves is defined; a needle, and possibly a sub-needle or selector, are accommodated in each one of said grooves and are slideable longitudinally along their respective groove. The needles or sub-needles are provided with a heel which can protrude from the related grooves of the needle supporting element, on the opposite side with respect to the bottom of the grooves, in order to engage within paths defined by cams which face the needle supporting element. Said paths are constituted by portions which are variously inclined with respect to the longitudinal extension of the grooves so that by actuating the needle supporting element with a transverse movement with respect to the grooves and the cams, a reciprocating movement of the needles along the related grooves causes said needles to grip the thread which is fed to them to form the stitches.

Some types of knitting require the use of all the needles mounted on the needle supporting element, whereas other types of knitting, such as for example the knitting of patterns, require a selection of the needles which must knit at a thread feed.

Various types of device for performing needle selection are known. In particular, in circular knitting machines for manufacturing stockings, i.e. in machines wherein the needle supporting element is constituted by a cylinder which is rotatable about its own axis with respect to the needle actuation cams, selection devices have long been used which use mechanical programmers which, by means of sliders, act on the heels of the sub-needles and are oscillatable in planes which are radial with respect to the cylinder in order to sink the heels in the grooves of the cylinder, thus avoiding engagement of the heels with the subsequent cam, which instead activates the needles having sub-needles which the selection sliders have not acted on.

Said types of device have the disadvantage of not being versatile in use, since in order to vary the selection of the needles it is necessary to intervene manually on the mechanical programmer which, in any case, only allows to produce relatively simple patterns.

Other types of selection device use, instead of mechanical programmers, electronic programmers which act on the heels of the needles or sub-needles by means of electromechanical or piezoelectric actuators. With these devices it is possible to obtain a correct selection even when the needle cylinder is actuated with high rotation rates, and it is possible to change the knitting which can be produced simply by changing the program of the electronic control element which actuates the various electromagnetic or piezoelectric actuators.

These kinds of selection devices, too, are not free from problems. In fact, the use of electromagnetic actuators entails relatively low response speeds which can penalize the productive potential of the machine, whereas piezoelectric actuators, which have higher response speeds, are fragile and expensive to manufacture and control.

Another method, adopted in order to increase the selection speed in combination with the above described methods, consists in differentiating the needles, or rather the sub-needles, into a plurality of rows, so that the heels of adjacent sub-needles are axially offset with respect to one another. This method uses as many actuators as there are rows of sub-needles. Each actuator can use, for its actuation, the time required for the transit, during the rotation of the needle cylinder, of all the sub-needles which belong to other rows, i.e. of all the sub-needles which have heels at different levels with respect to the level of the heel which can be actuated by means of that actuator. With this method it is possible to achieve high machine operating speeds, and thus high productivity, even with actuators which have relatively low response speeds.

However, this method has the problem that it must use very long sub-needles which entail a greater length of the needle cylinder and increase friction in the machine. Furthermore, the fitting of sub-needles divided into various rows is obviously more complicated than mutually identical sub-needles.

SUMMARY OF THE INVENTION

The aim of the present invention is to solve the problems encountered in the prior art knitting machines with needle selection devices.

Within this aim, an object of the present invention is to solve the problems described above by providing a knitting machine for manufacturing socks or stockings with a selection device which can be controlled electronically and offers adequate assurances of reliability even with high operating speeds.

Also within the scope of this aim, an object of the invention is to provide a machine with a selection device which can operate with needles or sub-needles of modest length in order to reduce friction-related losses and contain the wear of the various components of the machine.

Another object of the invention is to provide a machine with a selection device which can be produced with a reduced number of components.

This aim, these objects and others which will become apparent hereinafter are achieved by a knitting machine with needle selection device, comprising a needle supporting element, in which a plurality of grooves is defined, each groove slideably accommodating a needle, and at least one actuation cam facing said needle supporting element and being engageable, by virtue of the movement of said needle supporting element with respect to said cam along a direction which is transverse to the extension of said grooves, with a portion of said needles or of sub-needles which are arranged in said grooves, in order to move said needles or sub-needles along the related groove, said needles or sub-needles being movable from an active position, in which they engage said actuation cam, to an inactive position, in which they do not interfere with said actuation cam, a selection device being provided which acts on said needles or sub-needles in order to move them from said active position to said inactive position, or vice versa, characterized in that said needles or sub-needles have at least one magnetized portion and in that said selection device comprises: a selection element made of magnetizable material arranged proximate to the magnetized portion of each needle or sub-needle in the related groove of the needle supporting element, magnetizing means facing said needle supporting element at said selection element and being controllably activatable in order to induce, in said selection element, a magnetic field which is orientated according to the magnetic field which is present in said magnetized portion of the needle or sub-needle in order to generate a magnetic interaction between the needle or sub-needle and the related selection element, actuation means being provided which cooperate with said selection element in order to transfer, or keep, the related needle or sub-needle in said active position or in said inactive position according to the orientation of the magnetic field induced in said selection element.

BRIEF DESCRIPTION OF THE DRAWINGS

Further characteristics and advantages of the invention will become apparent from the description of a preferred but not exclusive embodiment of a machine with needle selection device according to the invention, illustrated only by way of non-limitative example in the accompanying drawings, wherein.

DESCRIPTION OF THE PREFERRED EMBODIMENTS

Figure 1:
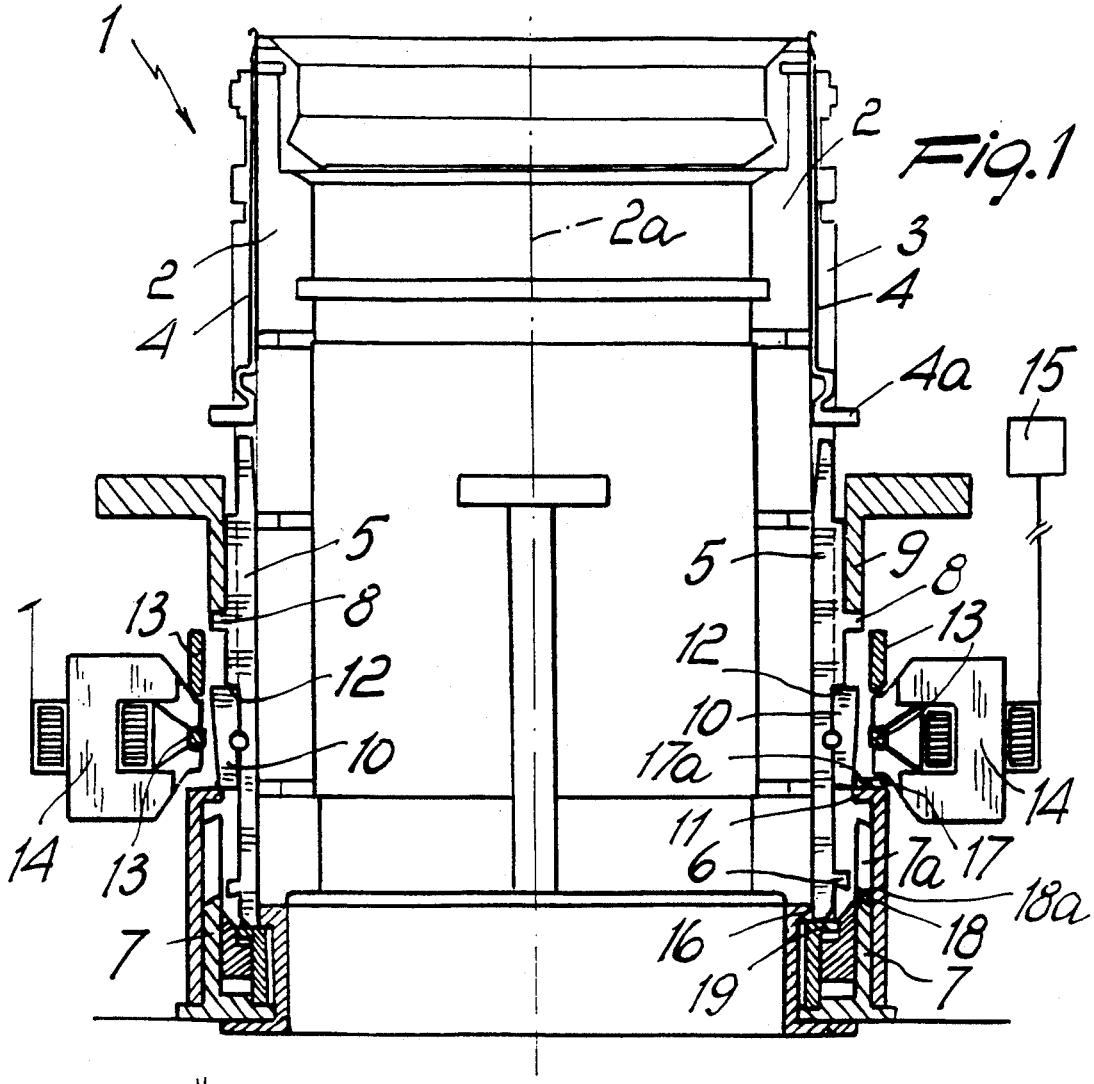
FIG. 1 is a schematic vertical sectional view of the machine according to the invention.

With reference to the above figures, the machine according to the invention, generally designated by the reference numeral 1, comprises a needle supporting element which is constituted, in the illustrated embodiment, which refers to a circular knitting machine for manufacturing socks or stockings, by a needle cylinder 2. The cylinder 2 has an axis 2*a* arranged vertically and a skirt whereon a plurality of grooves 3, which extend parallel to the axis 2*a*, are defined. Each groove slideably accommodates a needle member, consisting of a needle 4 arranged inside each groove 3, and a sub-needle 5 is arranged below said needle 4; both can slide along the related groove.

A plurality of cams is arranged around the needle cylinder 2 in a known manner. Said cams define paths, with portions which are variously inclined with respect to the longitudinal extension of the grooves, for the heels 4*a* of the needles which protrude radially from said grooves. The needle cylinder 2 can be rotated about its own axis 2*a* with respect to said cams so as to actuate the needles. The needles engage said paths with their heels, with a reciprocating motion along the related grooves in order to perform the required knitting. Said cams also define paths which exclude the related needles from knitting. Transfer of the needles from the inactive paths to the active paths is obtained by lifting the related sub-needle 5 along the groove so as to push the related needle, which moves with its heel from one path to the other.

Each sub-needle is provided with a lower heel 6 which is engageable with an actuation cam 7 laterally facing the needle cylinder. Said actuation cam has at least one ascent portion 7*a*, in order to cause the ascent of the sub-needles which engage it, and at least one descent portion, not shown, in order to allow the return of the sub-needle to its lowered position.

Each sub-needle is furthermore provided with an upper heel 8 which engages the profile of an upper cam 9. The upper cam 9 has descent portions for lowering the sub-needle and ascent portions for allowing ascent of the sub-needle, actuated by the actuation cam 7. The sub-needles 5 can furthermore oscillate on a plane which is radial to the needle cylinder 2, i.e. in a plane which is parallel to the sides of the related groove, in order to pass from an active position, wherein they protrude radially with their lower heel 6 from the related groove in order to engage the actuation cam 7, to an inactive position, wherein they are sunk, with the lower heel 6, in the related groove so as not to engage the actuation cam 7.

According to the invention, at least one portion of the sub-needles 5 is magnetized, and a selection element 10, made of magnetizable material, is arranged adjacent to said portion of each sub-needle, on the side of the sub-needle which is directed laterally and toward the outside of the needle cylinder.

The magnetized portion of the sub-needle 5 has a first magnetic field and can be made of permanently magnetic material or of semi-permanently magnetic material having a very wide rectangular hysteresis characteristic, for example a material commercially known by the trade-name "CROVAC", which is magnetized by subjecting it to the action of a very strong magnetic field.

The selection element 10 can also be made of semi-permanently magnetic material with a hysteresis characteristic which is rectangular but significantly narrower with respect to the material used for the magnetized portion of the sub-needle 5, for example a material commercially known by the trade-name "VACOZET".

The selection element 10 is substantially constituted by a plate which faces an intermediate portion of the sub-needle 5, is partially accommodated in the related groove of the needle cylinder and faces, with its lower end, a supporting ring 11 which surrounds the needle cylinder and, with its upper end, an abutment 12 defined by the sub-needle itself.

In order to prevent the selection elements 10 from being ejected out of the needle cylinder, retention means are provided which are constituted by an annular cage 13 which surrounds the needle cylinder in the region where the selection elements are located.

Figure 2:
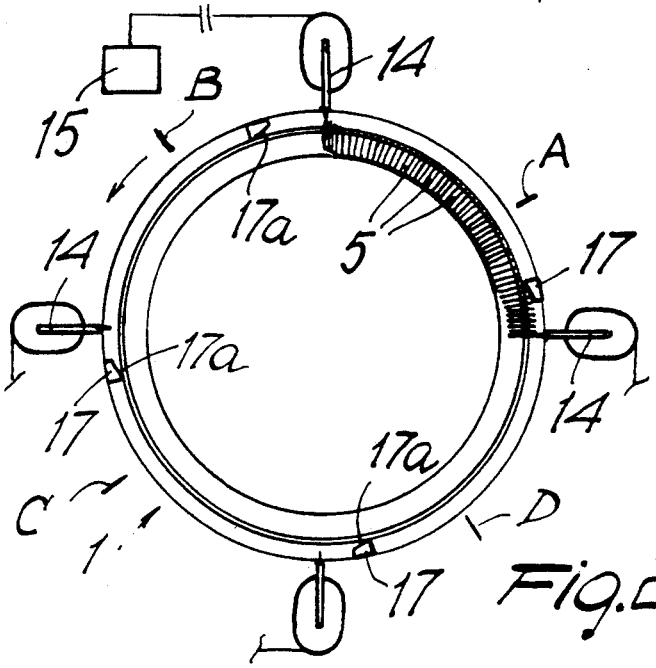
FIG. 2 is a schematic top plan view of the machine according to the invention.
Figure 3:
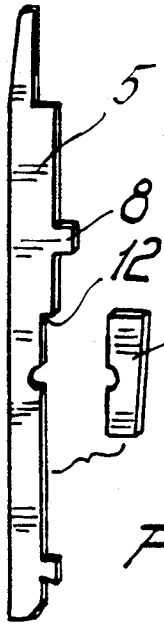
FIG. 3 is an exploded perspective view of a sub-needle of the machine according to the invention, with the related selection element.

Upstream of a thread feed, schematically designated in FIG. 2 by the letter A, along the direction of rotation of the needle cylinder with respect to the actuation cam 7, there are magnetizing means, constituted by an electromagnet 14 or magnetic write head which laterally faces the skirt of the needle cylinder at the level of the selection elements 10 and is controlled by an electronic control element 15, for example a programmable microprocessor, which controls the operation of the various elements of the machine according to the knitting requirements.

The electronic control element 15 controls, in a known manner, for example by means of an encoder or other device, the rotation rate of the needle cylinder, and the actuation of the electromagnet 14 is synchronized with said rotation rate, so that activation of the electromagnet 14 occurs every time a selection element 10 faces it.

The actuation of the electromagnet 14 generates a second magnetic field which magnetizes the selection elements 10 so that they interact magnetically with the first magnetic field of the magnetized portion of the sub-needle 5.

Depending on the direction of the current which flows through the turns of the electromagnet 14, the magnetic field induced in the selection elements 10 is such as to either cause attraction between the magnetized portion of the sub-needle and the selection element, or produce a repulsion. In the case of magnetic attraction, the selection element 10 is connected to the sub-needle and thus rigidly associated therewith in movement along the related groove of the needle cylinder, whereas in the case of magnetic repulsion, or in any case of lack of attraction, a relative movement of the sub-needle with respect to the related selection element is possible, particularly in a longitudinal direction, as will become apparent hereinafter.

Between the magnetizing means and the actuation cam there are actuation means which cooperate with the selection element 10 in order to transfer or keep the related sub-needle in the active position or in the inactive position, depending o the orientation of the magnetic field induced in the selection element, i.e. depending on whether the selection element is magnetically linked to the related sub-needle or is disconnected therefrom, as explained above.

Upstream of the electromagnet 14 along the rotation direction of the needle cylinder there are sub-needle extraction means which are constituted, in a known manner, by an extraction cam 16 which acts on the inner side of the sub-needles in order to transfer them from the inactive position to the active position.

The transfer of the sub-needles to the active position, in addition to moving the lower heel 6 into a position which allows it to engage the actuation cam 7, also moves the selection element 10 to a position which protrudes further from the related groove of the needle cylinder, so that it is extremely close to the electromagnet 14 when facing it.

Said actuation means comprise deactivation means which are arranged between the electromagnet 14 and the actuation cam 7 and are constituted by a deactivation cam 17 which is applied to, or defined monolithically with, the upper face of the supporting ring 11 which faces the lower end of the selection elements 10. Said cam 17 has a profile 17*a* which o extends progressively closer to the needle cylinder along the direction of rotation thereof, in order to push, by acting on the selection element which engages therewith, the related sub-needle toward the axis 2*a* of the needle cylinder or return it to its inactive position.

The actuation means furthermore comprise pre-actuation means constituted by a pre-actuation cam 18 arranged between the electromagnet 14 and the deactivation cam 17. Said pre-actuation cam 18 laterally faces the needle cylinder and has a rising portion 18*a* on which the lower heel of the sub-needles engages.

The height of the ascent portion 18*a* is greater than the height of the deactivation cam 17 with respect to the supporting plane defined by the ring 11, so as to allow the selection element 10, if it is magnetically linked to the related sub-needle, to pass beyond the deactivation cam 17 without interfering therewith, as will become apparent hereinafter.

The pre-actuation cam 18 can be defined monolithically with the actuation cam 7.

For the sake of completeness in description, it should be noted that proximate to the lower end of the needle cylinder there is a supporting ring 19 for the lower end of the sub-needles 5.

Conveniently, furthermore, the elements of the machine which are arranged very close to the elements subjected to magnetization are made of non-magnetic material.

The machine may have a single feed or multiple feeds, as shown in FIG. 2, which illustrates a machine with four feeds A, B, C and D, providing a selection device according to the invention upstream of each feed.

The operation of the machine as regards needle selection is as follows.

When operation begins, the sub-needles 5 are sunk, with their lower heel 6, in the related grooves 3 of the needle cylinder 2 and rest, with their lower end, on the ring 19, whereas the selection elements 10 rest, with their lower end, on the supporting ring 11.

The rotation of the needle cylinder about its axis 2*a* with respect to the various cams and to the electromagnet 14 moves the sub-needles 5 so that they interfere, upstream of the electromagnet 14, with the extraction cam 16 which, by making them oscillate in a plane which is radial with respect to the needle cylinder, moves their lower heel 6 so that it protrudes from the related groove, i.e. moves it to the active position.

Figure 4:
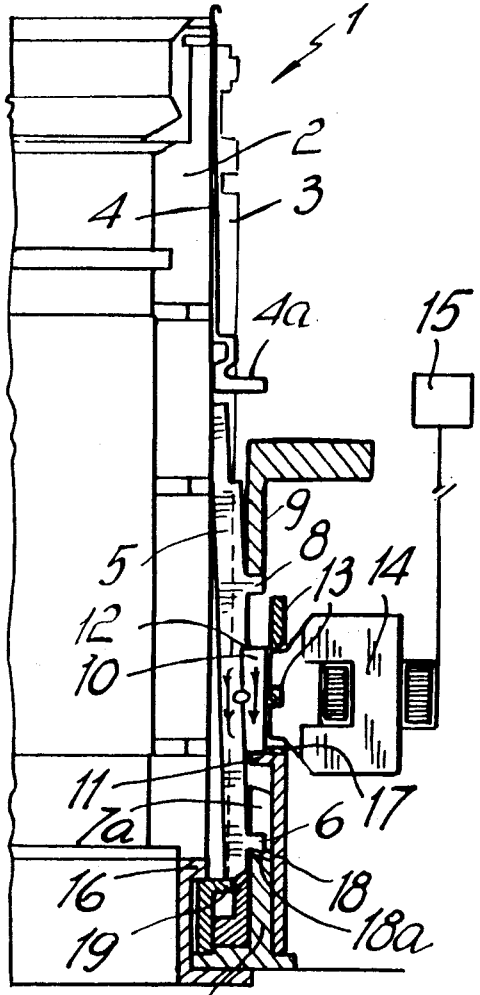

In this condition, if a needle must be excluded from knitting at the feed being considered, the electromagnet 14 is activated when the related sub-needle faces it, so as to magnetize the selection element 10 with a magnetic field which generates repulsion, or at least non-attraction, between the selection element 10 and the sub-needle 5 (FIG. 4).

Figure 5:
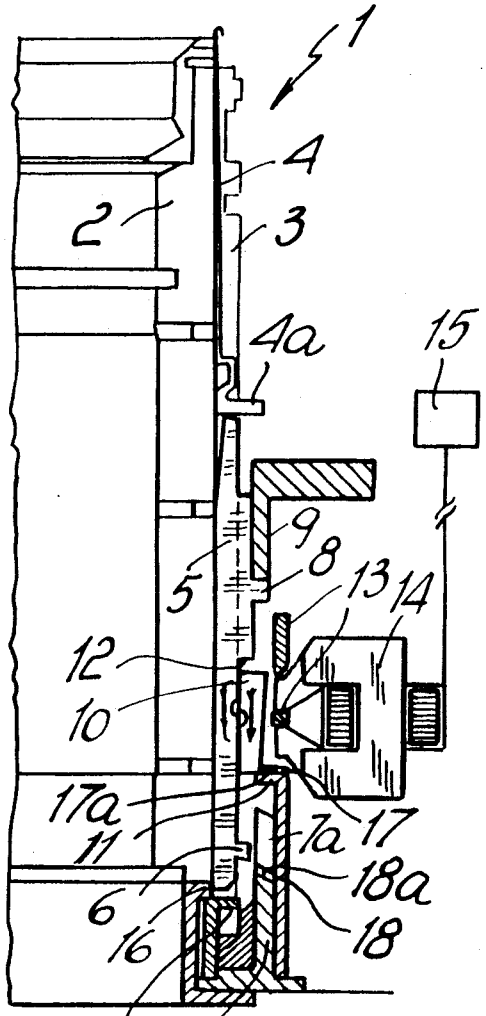

Downstream of the electromagnet 14, the lower heel 6 engages the ascent portion 18*a* of the pre-actuation cam 18, causing a slight ascent of the sub-needle 5, whereas the selection element, being disconnected therefrom, remains resting on the ring 11 and thus engages the deactivation cam 17, which pushes the selection element and the related sub-needle toward the bottom of the groove, causing the retraction of the lower heel 6 into said groove (FIG. 5). In this manner, this heel does not engage the actuation cam 7, and the overlying needle is not moved to knit.

Figure 6:
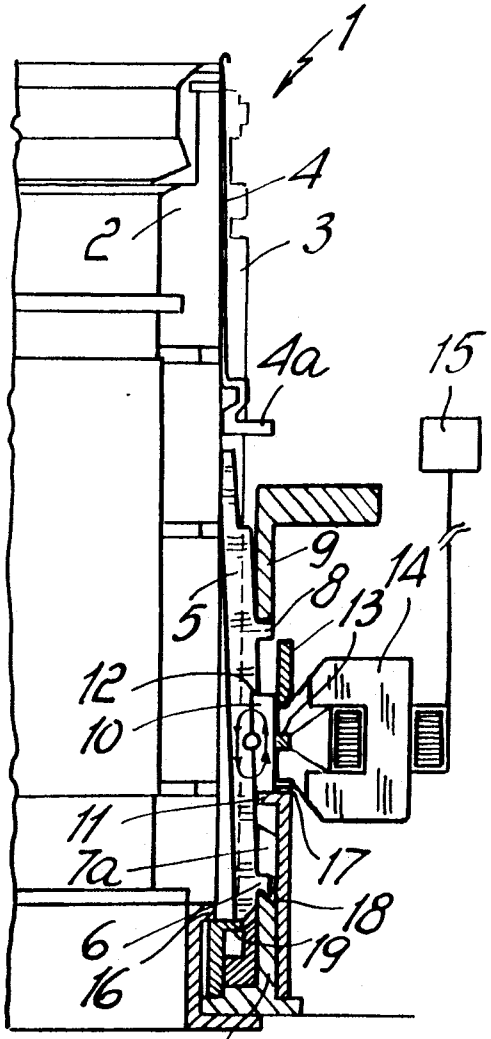
FIGS. 4 to 8 are schematic views of the operation of the selection device of the machine according to the invention.

When instead a needle is to be moved to knit, the electromagnet 14 is activated, supplying it with a reverse current with respect to the one of the preceding situation, so as to magnetize the selection element 10 with a magnetic field which generates attraction between the selection element 10 and the related sub-needle (FIG. 6).

Figure 7:
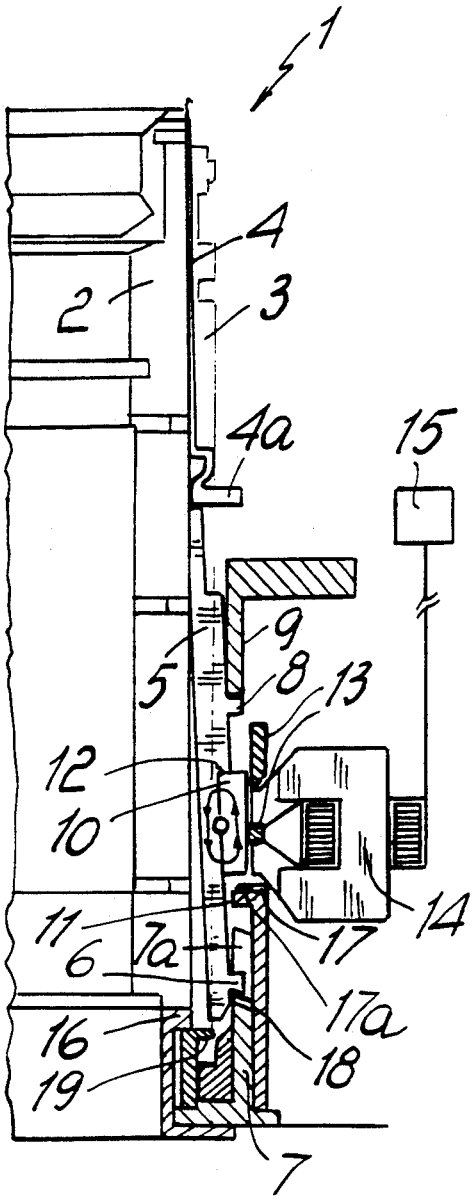

In this manner, when the lower heel 6 engages the ascent portion 18*a* of the pre-actuation cam 18, both the sub-needle 5 and the selection element 10, which is rigidly associated with said sub-needle by magnetic attraction (FIG. 7), are raised.

Figure 8:
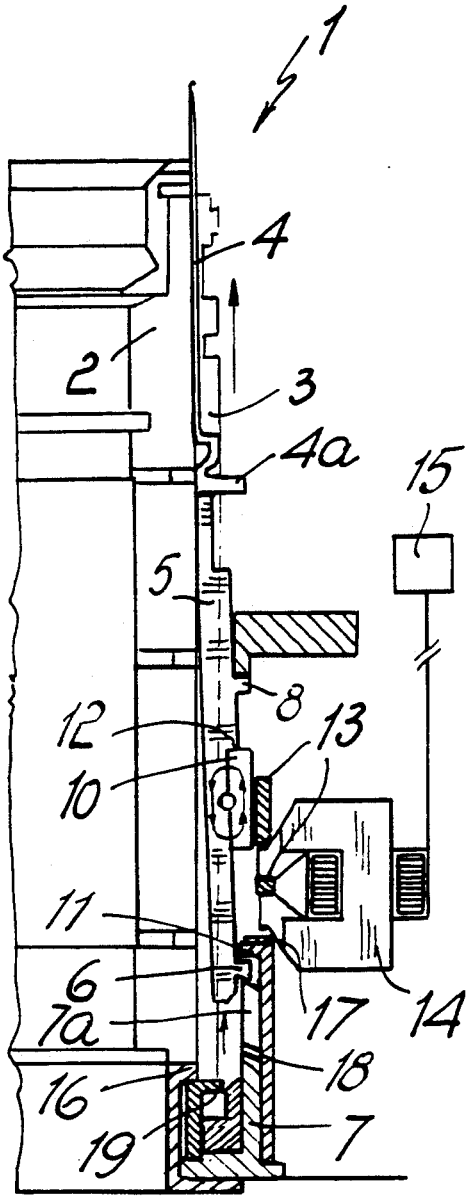

Due to this rise, the selection element 10 passes above the deactivation cam 17, which accordingly cannot act on the selection element, and thus the related sub-needle remains in an active position and engages the actuation cam 7, raising the overlying needle, which is moved to knit (FIG. 8).

After the sub-needle has moved the overlying needle to knit, it is lowered again with the related selection element by the upper cam 9, which acts on the upper heel 8, so as to undergo a new selection at a subsequent selection device or at the same selection device.

In practice, the selection device according to the invention achieves needle selection by using the different behavior of the assembly constituted by the sub-needle and by the selection needle, depending on the magnetic interaction induced between said elements by virtue of magnetization with a field with is orientated concordantly or oppositely with respect to the magnetic field which exists in the portion of the needle or sub-needle, or in the entire needle or sub-needle, and by then acting with actuation means which move the needle or sub-needle or selection element which causes engagement or non-interference of the needle or sub-needle with an actuation cam, depending on whether the selection element is rigidly associated, by magnetic attraction, or not coupled, by repulsion or neutral magnetic reaction, to the needle or sub-needle during said movement.

The intensity of the magnetic field generated by the electromagnet 14 is significantly smaller than the one used to magnetize the portion or the entire sub-needle, so that the magnetic field generated by the electromagnet 14 does not significantly change the permanent magnetic field of the sub-needle.

The intensity of the magnetic field generated by the electromagnet 14 is in any case such as to "erase" any magnetization of opposite orientation received by the selection element 10 in a preceding selection.

In practice, it has been observed that the machine with selection device according to the invention fully achieves the intended aim, since it allows to select the needles very precisely and reliably even with high machine operating speeds.

Figure 9:
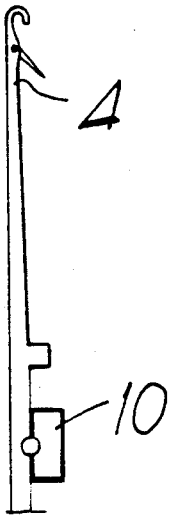
FIG. 9 is a schematic view illustrating a selection element applied directly to a needle for direct needle selection.

Although the basic concept of the machine according to the invention has been illustrated with particular reference to a circular knitting machine for manufacturing stockings, it can be applied to other types of knitting machine. Furthermore, the selection element may be applied directly to the needles of a machine in order to allow direct needle selection, in the manner schematically illustrated in FIG. 9.

The machine with selection device thus conceived is susceptible to numerous modifications and variations, all of which are within the scope of the inventive concept; all the details may furthermore be replaced with technically equivalent elements.

In practice, the materials employed, so long as compatible with the specific use, as well as the dimensions, may be any according to the requirements and the state of the art.

I claim:

1. Knitting machine with needle selection device, comprising a needle supporting element, a plurality of grooves having a longitudinal extension defined in said needle supporting element, a needle member slideably accommodated in each of said grooves, and at least one actuation cam, said actuation cam facing said needle supporting element and being engageable, upon movement of said needle supporting element with respect to said cam along a direction transverse to said longitudinal extension of said grooves, with a portion of said needle member, said needle member being movable along one of said grooves from an active position, whereat said needle member engages said actuation cam, to an inactive position, whereat said needle member does not interferer with said actuation cam, said knitting machine further comprising a selection device, said selection device acting on said needle member for moving said needle member between said active position and said inactive position, wherein said needle member has at least one magnetized portion, said magnetized portion defining a first magnetic field, and wherein said selection device comprises a selection element and magnetizing means, said selection element being made of magnetizable material and arranged proximate to said magnetized portion of said needle member in one of said grooves, said magnetizing means facing said needle supporting element at said selection element and being controllably activatable for inducing in said selection element a second magnetic field, said second magnetic field being oriented according to said first magnetic field, whereby to generate a magnetic interaction between said needle member and said selection element, actuation means cooperating with said selection element for transferring or keeping said needle member in said active position or in said inactive position according to orientation of said second magnetic field induced in said selection element.

2. Machine according to claim 1, wherein said selection element is constituted by a plate, and wherein each said needle member has an outwardly directed side, said outwardly directed side facing outside of one of said grooves, said plate facing said outwardly directed side, said needle supporting element being provided with means for retaining said selection element in said one of said grooves.

3. Machine according to claim 1, wherein said magnetizing means are constituted by an electromagnet, said electromagnet facing said needle supporting element and being operatively connected to an electronic machine control element each said selection element facing said electromagnet during movement of said needle supporting element with respect to said electromagnet and said actuation cam, said electromagnet being arranged upstream of said actuation cam along a direction of motion defined by movement of said needle supporting element with respect to said actuation cam.

4. Machine according to claim 1, wherein said needle member comprises a needle and a sub-needle, said sub needle having an intermediate portion and a heel, said selection element facing said intermediate portion, said grooves each having sides, said sides transversely delimiting said grooves, said intermediate portion being aligned longitudinally with respect to said needle, said sub-needle being movable in a plane parallel to said sides from said active position, whereat said heel protrudes from said groove in order to engage said actuation cam, to said inactive position, whereat said heel is sunk in said groove so as not to interfere with said actuation cam.

5. Machine according to claim 1, further comprising extraction means arranged upstream of said magnetizing means, with respect to said direction of motion of said needle supporting element, said extraction means acting on said needle members, whereby to transfer said needle members from said inactive position to said active position.

6. Machine according to claim 1, wherein said actuation means comprise deactivation means, said deactivation means facing said needle supporting element and being arranged between said magnetizing means and said actuation cam, said deactivation means being engageable with said selection element, said selection element magnetically repelling said needle member, pre-actuation means being arranged between said magnetizing means and said deactivation means, said pre-actuation means acting on said needle member in order to move said needle member longitudinally along said one of said grooves, with consequent movement of said selection element magnetically linked thereto, whereby to pass beyond said deactivation means without interference.

7. Machine according to claim 6, wherein said deactivation means are constituted by a deactivation cam, said deactivation cam facing said needle supporting element and having a profile, said profile extending progressively closer to said needle supporting element.

8. Machine according to claim 6, wherein said needle member has a heel, and wherein said pre-actuation means comprise a pre-actuation cam, said pre-actuation cam defining an inclined profile, said inclined profile facing said needle supporting element and being inclined with respect to a direction of motion of said needle supporting element, said inclined profile being engageable with said heel of said needle member, whereby to move said needle member along said one of said grooves.

9. Machine according to claim 6, wherein said pre-actuation means comprise a pre-actuation cam, and wherein said actuation cam and said pre-actuation cam are defined monolithically.

10. Machine according to claim 1, wherein said needle supporting element is constituted by a cylinder having an axis, said cylinder being arranged vertically said needle member being slideable along a direction parallel to said axis of said needle cylinder, said cylinder being rotatable about said axis with respect to said actuation cam and with respect to said magnetizing means, and magnetizing means laterally facing said cylinder.

11. Machine according to claim 10, wherein said selection element has a lower end, and further comprising a supporting ring, said supporting ring supporting said lower end of said selection element and being arranged around said cylinder, said deactivation cam being applied to said supporting ring whereby to make contact with said lower end of said selection element.

12. Machine according to claim 6, wherein said needle supporting element comprises a cylinder, said selection element having a lower end, said machine further comprising a supporting ring, said supporting ring extending around said cylinder and supporting said lower end of said selection element and defining a supporting plane, wherein said pre-actuation means comprise a pre-actuation cam, wherein said deactivation means comprise a deactivation cam, and wherein said pre-actuation cam has a rising portion, said needle member comprising a needle and a sub-needle having a heel, said rising portion being engageable with said heel of said sub-needle and being higher than said deactivation cam with respect to said supporting plane defined by said supporting ring for said lower end of said selection element.

13. In combination, a needle member for knitting machines and a selection element, said needle member comprising an elongated body, said elongated body having at least one magnetized portion, said selection element facing said magnetized portion and being constituted by a plate, said plate being physically separate from said elongated body and made of a material magnetizable with an oriented magnetic field, said orientated magnetic field inducing magnetic interaction between said selection element and said magnetized portion of said needle member, whereby to produce attraction or repulsion of said elongated body of said needle member and said selection element, as a consequence of actions of elements of knitting machines on said body or on said selection element, depending on magnetic interaction induced between said magnetized portion of said needle member and said selection element.

14. Knitting machine with needle selection device, comprising:

a plurality of needles members, each needle member among said plurality of needle members being constituted by a body, said body having at least one magnetized portion;

a selection element facing said magnetized portion and being constituted by a plate, said plate being physically separate from said body of said needle member and made of magnetizable material;

a selection device, comprising magnetizing means, said magnetizing means controllably acting on said selection element, whereby to induce magnetic interaction between said magnetized portion of said needle member and said selection element; and actuation means acting on said body of said needle member or on said selection element for attraction or repulsion of said needle member according to the magnetic interaction induced between said magnetized portion of said body of said needle member and said selection element.

15. Process for performing needle selection in a knitting machine of the type having an actuation cam, said process comprising the steps of:

providing a needle member comprising at least one magnetized portion having a first magnetic field;

providing a selection element made of magnetizable material;

arranging said selection element adjacent to said magnetized portion;

magnetizing said selection element with a second magnetic field orientated, with respect to said first magnetic field existing in said magnetized portion of said needle member, whereby to induce attractive or repulsive or neutral magnetic action between said selection element and said needle or sub-needle, and;

moving said needle member or said selection element, whereby to cause engagement or non-interference of said needle member with said actuation cam, depending on whether said selection element is linked, by magnetic attraction, or not linked, by magnetic neutral reaction or repulsion, to said needle member during said movement.

* * * * *